US010273568B2

(12) United States Patent
Lee et al.

(10) Patent No.: US 10,273,568 B2
(45) Date of Patent: Apr. 30, 2019

(54) CELLULOSIC AND SYNTHETIC POLYMERIC FEEDSTOCK BARREL FOR USE IN RAPID DISCHARGE FORMING OF METALLIC GLASSES

(71) Applicant: Glassimetal Technology, Inc., Pasadena, CA (US)

(72) Inventors: David S. Lee, Wenham, MA (US); Joseph P. Schramm, Sierra Madre, CA (US); Marios D. Demetriou, West Hollywood, CA (US); William L. Johnson, San Marino, CA (US); Montague Rittgers, Pasadena, CA (US)

(73) Assignees: Glassimetal Technology, Inc., Pasadena, CA (US); Apple Inc., Cupertino, CA (US)

( * ) Notice: Subject to any disclaimer, the term of this patent is extended or adjusted under 35 U.S.C. 154(b) by 993 days.

(21) Appl. No.: 14/501,563

(22) Filed: Sep. 30, 2014

(65) Prior Publication Data

US 2015/0090375 A1 Apr. 2, 2015

Related U.S. Application Data

(60) Provisional application No. 61/974,267, filed on Apr. 2, 2014, provisional application No. 61/884,267, filed on Sep. 30, 2013.

(51) Int. Cl.
*C22F 1/00* (2006.01)
*C21D 1/34* (2006.01)
(Continued)

(52) U.S. Cl.
CPC ..... *C22F 1/00* (2013.01); *C21D 1/40* (2013.01); *C22F 1/002* (2013.01); *C22F 1/10* (2013.01);
(Continued)

(58) Field of Classification Search
CPC ..... C21D 1/40; C21D 2201/03; C22F 1/00; C22F 1/002; C22F 1/10; Y10T 428/1303;
(Continued)

(56) References Cited

U.S. PATENT DOCUMENTS 2,467,782 A 12/1947 Schuman
2,816,034 A 12/1957 Mittelmann
(Continued)

FOREIGN PATENT DOCUMENTS

CN 1552940 12/2004
CN 1689733 11/2005
(Continued)

OTHER PUBLICATIONS

Masuhr et al., Time Scales for Viscous Flow, Atomic Transport, and Crystallization in the Liquid and Supercooled Liquid States of Zr41.2Ti13.8Cu12.5Ni10.0Be22.5,: *Phys. Rev. Lett.*, vol. 82, (1999), pp. 2290-2293.
(Continued)

*Primary Examiner* — Yan Lan
(74) *Attorney, Agent, or Firm* — Polsinelli PC

(57) ABSTRACT

The present disclosure is directed to the use of cellulosic materials, such as wood, paper, etc., or synthetic polymeric materials, such as a thermoplastic, rubber, etc., or a composite containing one or more of these materials as feedstock barrels for the process of injection molding of metallic glasses by rapid capacitor discharge forming (RCDF) techniques.

19 Claims, 6 Drawing Sheets

(51) Int. Cl.

| | |
|---|---|
| ***B29C 45/00*** | (2006.01) |
| ***C21D 1/40*** | (2006.01) |
| ***C22F 1/10*** | (2006.01) |

(52) U.S. Cl.

CPC ..... *C21D 2201/03* (2013.01); *Y10T 428/1303* (2015.01); *Y10T 428/1314* (2015.01); *Y10T 428/1348* (2015.01); *Y10T 428/1352* (2015.01)

(58) Field of Classification Search

CPC ..... Y10T 428/1314; Y10T 428/1348; Y10T 428/1352

See application file for complete search history.

(56) References Cited

U.S. PATENT DOCUMENTS

| | | | | |
|---|---|---|---|---|
| 3,241,956 | A | 3/1966 | Inoue | |
| 3,250,892 | A | 5/1966 | Inoue | |
| 3,332,747 | A | 7/1967 | Bundy | |
| 3,537,045 | A | 10/1970 | Ichiro | |
| 3,863,700 | A | 2/1975 | Bedell et al. | |
| 4,115,682 | A | 9/1978 | Kavesh et al. | |
| 4,355,221 | A | 10/1982 | Lin | |
| 4,462,092 | A | 7/1984 | Kawabuchi et al. | |
| 4,523,748 | A | 6/1985 | Latter | |
| 4,715,906 | A | 12/1987 | Taub et al. | |
| 4,809,411 | A | 3/1989 | Lin et al. | |
| 4,950,337 | A | 8/1990 | Li et al. | |
| 5,005,456 | A | 4/1991 | Ballard et al. | |
| 5,069,428 | A | 12/1991 | Li et al. | |
| 5,075,051 | A | 12/1991 | Ito et al. | |
| 5,196,264 | A | 3/1993 | Tsuchiya et al. | |
| 5,278,377 | A | 1/1994 | Tsai | |
| 5,288,344 | A | 2/1994 | Peker et al. | |
| 5,324,368 | A | 6/1994 | Masumoto et al. | |
| 5,368,659 | A | 11/1994 | Peker et al. | |
| 5,427,660 | A | 6/1995 | Kamimura et al. | |
| 5,550,857 | A | 8/1996 | Richards | |
| 5,554,838 | A | 9/1996 | Berdich | |
| 5,618,359 | A | 4/1997 | Lin et al. | |
| 5,735,975 | A | 4/1998 | Lin et al. | |
| 5,896,642 | A | 4/1999 | Peker et al. | |
| 6,027,586 | A | 2/2000 | Masumoto et al. | |
| 6,235,381 | B1 | 5/2001 | Sanders et al. | |
| 6,258,183 | B1 | 7/2001 | Onuki et al. | |
| 6,279,346 | B1 * | 8/2001 | Ribes | C03B 9/447 264/334 |
| 6,293,155 | B1 | 9/2001 | Babiel | |
| 6,355,361 | B1 | 3/2002 | Ueno et al. | |
| 6,432,350 | B1 | 9/2002 | Seres et al. | |
| 6,771,490 | B2 | 8/2004 | Peker et al. | |
| 6,875,293 | B2 | 4/2005 | Peker | |
| 7,120,185 | B1 | 10/2006 | Richards | |
| 7,347,967 | B2 | 3/2008 | Kim et al. | |
| 7,506,566 | B2 | 3/2009 | Decristofaro et al. | |
| 7,883,592 | B2 | 2/2011 | Hofmann et al. | |
| 8,099,982 | B2 | 1/2012 | Takagi et al. | |
| 8,276,426 | B2 | 10/2012 | Musat et al. | |
| 8,499,598 | B2 | 8/2013 | Johnson et al. | |
| 8,613,813 | B2 | 12/2013 | Johnson et al. | |
| 8,613,814 | B2 | 12/2013 | Kaltenboeck et al. | |
| 8,613,815 | B2 | 12/2013 | Johnson et al. | |
| 8,613,816 | B2 | 12/2013 | Kaltenboeck et al. | |
| 8,776,566 | B2 | 7/2014 | Johnson et al. | |
| 2001/0033304 | A1 | 10/2001 | Ishinaga et al. | |
| 2002/0122985 | A1 | 9/2002 | Sato et al. | |
| 2003/0056562 | A1 | 3/2003 | Kamano | |
| 2003/0183310 | A1 | 10/2003 | McRae | |
| 2003/0222122 | A1 | 12/2003 | Johnson et al. | |
| 2004/0035502 | A1 | 2/2004 | Kang et al. | |
| 2004/0067369 | A1 | 4/2004 | Ott et al. | |
| 2005/0034787 | A1 | 2/2005 | Song et al. | |
| 2005/0103271 | A1 | 5/2005 | Watanabe et al. | |
| 2005/0202656 | A1 | 9/2005 | Ito et al. | |
| 2005/0217333 | A1 | 10/2005 | Daehn | |
| 2005/0236071 | A1 | 10/2005 | Koshiba et al. | |
| 2005/0263216 | A1 | 12/2005 | Chin et al. | |
| 2006/0102315 | A1 | 5/2006 | Lee et al. | |
| 2006/0293162 | A1 | 12/2006 | Ellison | |
| 2007/0003782 | A1 | 1/2007 | Collier | |
| 2007/0023401 | A1 | 2/2007 | Tsukamoto et al. | |
| 2007/0034304 | A1 | 2/2007 | Inoue et al. | |
| 2008/0081213 | A1 | 4/2008 | Ito et al. | |
| 2008/0135138 | A1 | 6/2008 | Duan et al. | |
| 2008/0302775 | A1 | 12/2008 | Machrowicz | |
| 2009/0236017 | A1 | 9/2009 | Johnson et al. | |
| 2009/0246070 | A1 | 10/2009 | Tokuda et al. | |
| 2010/0009212 | A1 | 1/2010 | Utsunomiya et al. | |
| 2010/0047376 | A1 | 2/2010 | Imbeau et al. | |
| 2010/0121471 | A1 | 5/2010 | Higo et al. | |
| 2010/0320195 | A1 | 12/2010 | Fujita et al. | |
| 2011/0048587 | A1 | 3/2011 | Vecchio et al. | |
| 2012/0103478 | A1 | 5/2012 | Johnson et al. | |
| 2013/0025814 | A1 * | 1/2013 | Demetriou | C21D 1/40 164/250.1 |
| 2013/0048152 | A1 | 2/2013 | Na et al. | |
| 2013/0319062 | A1 | 12/2013 | Johnson et al. | |
| 2014/0033787 | A1 | 2/2014 | Johnson et al. | |
| 2014/0047888 | A1 | 2/2014 | Johnson et al. | |
| 2014/0083150 | A1 | 3/2014 | Kaltenboeck et al. | |
| 2014/0102163 | A1 | 4/2014 | Kaltenboeck et al. | |
| 2014/0130563 | A1 | 5/2014 | Lee et al. | |
| 2014/0283956 | A1 | 9/2014 | Schramm et al. | |
| 2015/0096967 | A1 | 4/2015 | Lee et al. | |
| 2015/0231675 | A1 | 8/2015 | Johnson et al. | |
| 2015/0367410 | A1 | 12/2015 | Schramm et al. | |
| 2016/0298205 | A1 | 10/2016 | Johnson et al. | |

FOREIGN PATENT DOCUMENTS

| | | |
|---|---|---|
| CN | 201838352 | 5/2011 |
| CN | 103320783 | 9/2013 |
| EP | 0921880 | 6/1999 |
| EP | 2556178 | 2/2013 |
| FR | 2806019 | 9/2001 |
| GB | 215522 | 5/1924 |
| GB | 2148751 | 6/1985 |
| JP | 48-008694 | 3/1973 |
| JP | 63-220950 | 9/1988 |
| JP | H06-57309 | 3/1994 |
| JP | H06-277820 | 10/1994 |
| JP | H 08-024969 | 1/1996 |
| JP | 08-300126 | 11/1996 |
| JP | 10-263739 | 10/1998 |
| JP | 10-296424 | 11/1998 |
| JP | 11-001729 | 1/1999 |
| JP | 11-104810 | 4/1999 |
| JP | 11-123520 | 11/1999 |
| JP | 11-354319 | 12/1999 |
| JP | 2000-119826 | 4/2000 |
| JP | 2000-169947 | 6/2000 |
| JP | 2001-321847 | 11/2001 |
| JP | 2001-347355 | 12/2001 |
| JP | 2003-509221 | 3/2003 |
| JP | 2005-209592 | 8/2005 |
| JP | 2008-000783 | 1/2008 |
| JP | 2011-517623 | 6/2011 |
| JP | 2013-530045 | 7/2013 |
| KR | 10-0271356 | 11/2000 |
| WO | WO 01/21343 | 3/2001 |
| WO | WO 2009/048865 | 4/2009 |
| WO | WO 09/117735 | 9/2009 |
| WO | WO 11/127414 | 10/2011 |
| WO | WO 12/051443 | 4/2012 |
| WO | WO 12/092208 | 7/2012 |
| WO | WO 12/103552 | 8/2012 |
| WO | WO 12/112656 | 8/2012 |
| WO | WO 2014/078697 | 5/2014 |

OTHER PUBLICATIONS

Schroers et al., "Pronounced asymmetry in the crystallization behavior during constant heating and cooling of a bulk metallic glass-

(56) References Cited

OTHER PUBLICATIONS forming liquid," Phys. Rev. B, vol. 60, No. 17 (1999), pp. 11855-11858.
Johnson et al., "A Universal Criterion for Plastic Yielding of Metallic Glasses with a (T/Tg)2/3 Temperature Dependence," *Physical Review Letter*, (2005), PRL 95, pp. 195501-195501-4.
Saotome et al., "Characteristic behavior of Pt-based metallic glass under rapid heating and its application to microforming," *Materials Science and Engineering A*, 2004, vol. 375-377, pp. 389-393.
De Oliveira et al., "Electromechanical engraving and writing on bulk metallic glasses", Applied Physics Letters, Aug. 26, 2002, vol. 81, No. 9, pp. 1606-1608.
Duan et al., "Bulk Metallic Glass with Benchmark Thermoplastic Processability", Adv. Mater., 2007, vol. 19, pp. 4272-4275.
Ehrt et al., "Electrical conductivity and viscosity of borosilicate glasses and melts," Phys. Chem. Glasses: Eur. J. Glass Sci. Technol. B, Jun. 2009, 50(3), pp. 165-171.
Love, "Temperature dependence of electrical conductivity and the probability density function," J. Phys. C: Solid State Phys., 16, 1983, pp. 5985-5993.
Mattern et al., "Structural behavior and glass transition of bulk metallic glasses," Journal of Non-Crystalline Solids, 345&346, 2004, pp. 758-761.
Wiest et al., "Zi—Ti-based Be-bearing glasses optimized for high thermal stability and thermoplastic formability", Acta Materialia, 2008, vol. 56, pp. 2625-2630.
Yavari et al., "Electromechanical shaping, assembly and engraving of bulk metallic glasses", Materials Science and Engineering A, 2004, vol. 375-377, pp. 227-234.
Yavari et al., "Shaping of Bulk Metallic Glasses by Simultaneous Application of Electrical Current and Low Stress", Mat. Res. Soc. Symp. Proc., 2001, vol. 644, pp. L12.20.1-L12.20.6.
Demetriou, Document cited and published during Applicant Interview Summary conducted on Jan. 29, 2013, entitled, "Rapid Discharge Heating & Forming of Metallic Glasses: Concepts, Principles, and Capabilities," Marios Demetriou, 20 pages.
U.S. Appl. No. 14/629,357, filed Feb. 23, 2015, Johnson et al.
Kulik et al., "Effect of flash- and furnace annealing on the magnetic and mechanical properties of metallic glasses," *Materials Science and Engineering*, A133 (1991), pp. 232-235.

* cited by examiner

CELLULOSIC AND SYNTHETIC POLYMERIC FEEDSTOCK BARREL FOR USE IN RAPID DISCHARGE FORMING OF METALLIC GLASSES

CROSS-REFERENCE TO RELATED APPLICATIONS

The present application claims the benefit under 35 U.S.C. § 119(e) of U.S. Provisional Patent Application No. 61/884,267, entitled "Cellulosic Feedstock Barrel for Use in Rapid Discharge Forming of Metallic Glasses", filed on Sep. 30, 2013 and U.S. Provisional Patent Application No. 61/974,267, entitled "Cellulosic and Synthetic Polymeric Feedstock Barrel for Use in Rapid Discharge Forming of Metallic Glasses", filed on Apr. 2, 2014, which are incorporated herein by reference in their entirety.

FIELD

The present disclosure relates to the use of cellulosic materials, or synthetic polymeric materials or composites thereof, as feedstock barrels for the processing of metallic glasses by rapid capacitor discharge forming (RCDF) techniques.

BACKGROUND

U.S. Pat. No. 8,613,813, is directed, in certain aspects, to a method of rapidly heating and shaping a metallic glass using a rapid discharge of electrical current, where a quantum of electrical energy is discharged through a substantially defect-free metallic glass sample having a substantially uniform cross-section to rapidly heat the sample to a processing temperature between the glass transition temperature of the metallic glass and the equilibrium melting temperature of the metallic glass forming alloy, and then applying a deformational force to shape the heated sample into an article, and then cooling said sample to form a metallic glass article.

U.S. Patent Publication No. 2013/0025814 is directed, in certain aspects, to a method and apparatus of injection molding metallic glass articles using the RCDF method, including an insulated feedstock barrel, or "barrel," that is used to electrically insulate and mechanically confine the heated feedstock. Each of the foregoing patent publications is incorporated herein by reference in its entirety.

One class of material that has been explored is toughened ceramics. Examples of proposed ceramic barrel materials include Macor, yttria-stabilized zirconia or fine-grained alumina. Ceramics are electrically insulating and chemically very stable up to high temperatures, and when properly processed they may have substantial toughness and machinability. But ceramics are generally relatively expensive materials, and the various processes used to toughen them are complex, labor intensive, and add significantly to the overall cost. Machining of ceramics is generally hard, time intensive, and requires expensive tooling. Moreover, the requirement for split-barrel design further complicates the machining process and adds to the overall cost. Therefore, even if an extended tool life is achieved with toughened ceramics enabling multiple RCDF cycles, owing to the high overall cost, the cost per RCDF cycle with ceramic barrels can still be prohibitively high for many applications.

SUMMARY

In some embodiments, the disclosure is directed to a feedstock barrel for use in an RCDF cycle wherein the barrel includes a cellulosic material, or synthetic polymeric material, or composite thereof. In some embodiments, the disclosure is directed to a feedstock barrel for use in an RCDF injection molding cycle wherein the barrel includes a cellulosic material, such as wood, paper, etc. In some embodiments, the disclosure is directed to a feedstock barrel for use in an RCDF injection molding cycle wherein the barrel includes a synthetic polymeric material such as a thermoplastic, rubber, etc., or a composite containing one or more of these materials.

In some embodiments, the disclosure is directed to an RCDF apparatus including a feedstock barrel that comprises a cellulosic material, or synthetic polymeric material, or composite thereof. In various embodiments, the RCDF apparatus further includes a source of electrical energy to heat a feedstock sample, which is electrically connected to at least one of a pair of electrodes. The electrodes electrically connect the source of electrical energy to the feedstock sample when the feedstock sample is loaded in the feedstock barrel. In some embodiments, the electrodes can be disposed at opposing ends of the feedstock barrel. The RCDF apparatus can also include a shaping tool disposed in forming relation to the feedstock sample and configured to apply a deformational force to shape the feedstock sample, when heated, in to an article. In further embodiments, the shaping tool can be configured to cool the article at a rate sufficient to avoid crystallization in the article.

In various embodiments, the cellulosic material, or synthetic polymeric material or composite thereof, can have a toughness and fracture toughness such that the barrel does not suffer catastrophic mechanical failure during the RCDF injection molding cycle. In various embodiments, the cellulosic material, or synthetic polymeric material or composite thereof, can have an electrical resistivity and breakdown voltage such that essentially no electrical current (i.e. <10 A, and in some embodiments less than 1 A) flows through the barrel during the RCDF injection molding cycle. In various embodiments, the cellulosic material, or synthetic polymeric material or composite thereof, can have a thermal and chemical stability such that catastrophic ignition of the material is prevented during the RCDF injection molding cycle.

In other embodiments, the cellulosic material, or synthetic polymeric material, or composite thereof, may have a critical strain energy release rate of at least 0.1 $J/m^2$. In other embodiments, the cellulosic material, or synthetic polymeric material, or composite thereof, may have a fracture toughness of at least 0.05 MPa $m^{1/2}$.

In various embodiments, the cellulosic material, or synthetic polymeric material, or composite thereof, may have an electrical resistivity of at least $1\times10^5$ μΩ-cm. In various embodiments, the cellulosic material, or synthetic polymeric material, or composite thereof, may have an electrical resistivity at least $10^3$ times higher than the electrical resistivity of the bulk metallic glass feedstock. In various embodiments, the cellulosic material, or synthetic polymeric material, or composite thereof, may have a dielectric breakdown strength of at least 100 V/mm. In various embodiments, the cellulosic material, or synthetic polymeric material, or composite thereof, can resist catastrophic ignition when exposed to a temperature of up to 800° C. for up to 0.5 s.

In still other embodiments, the disclosure is directed to a cellulosic material, or synthetic polymeric material, or composite thereof, for forming feedstock barrels that can be used to electrically insulate and mechanically confine a metallic glass feedstock during an RCDF injection molding cycle. The cellulosic material, or synthetic polymeric material, or composite thereof, can have a toughness and fracture toughness such that the material does not suffer catastrophic mechanical failure during the RCDF injection molding cycle. The cellulosic material, or synthetic polymeric material, or composite thereof, can have an electrical resistivity and a breakdown voltage such that essentially no electrical current (i.e. <10 A, and in some embodiments less than 1 A) flows through the material during the RCDF injection molding cycle. The cellulosic material, or synthetic polymeric material, or composite thereof, can have a thermal and chemical stability such that catastrophic ignition of the material is prevented during the RCDF injection molding cycle.

In still yet other embodiments, the disclosure is directed to a method of electrically insulating and mechanically confining a bulk metallic glass feedstock during an RCDF cycle. The steps can include:

providing a feedstock barrel formed from a cellulosic material, or synthetic polymeric material, or composite thereof;

disposing a bulk metallic glass feedstock within said barrel; and subjecting said feedstock to an RCDF injection molding cycle.

In various embodiments, the cellulosic material, or synthetic polymeric material, or composite thereof, can have a toughness and fracture toughness such that the material does not suffer catastrophic mechanical failure during the RCDF injection molding cycle. The cellulosic material, or synthetic polymeric material, or composite thereof, can have an electrical resistivity and breakdown voltage such that essentially no electrical current (i.e. <10 A, and in some embodiments less than 1 A) flows through the material during the RCDF injection molding cycle. The cellulosic material, or synthetic polymeric material, or composite thereof, can have a thermal and chemical stability such that catastrophic ignition or decomposition of the material is prevented during the RCDF injection molding cycle.

In still other embodiments, the disclosure is directed to a method of shaping a bulk metallic glass feedstock during an RCDF injection molding cycle. The steps include discharging electrical energy across a metallic glass sample disposed in a feedstock barrel formed from a cellulosic material or synthetic polymer material, or composite thereof to a processing temperature between the glass transition temperature Tg and the melting temperature Tm of the metallic glass sample to heat the metallic glass sample, and applying a deformational force to shape the heated metallic glass sample into an article. In some embodiments, at least 50 Joules of energy is discharged in the discharging step. In some embodiments, the metallic glass feedstock sample may be heated at a rate of at least 500 K/s. In still other embodiments, the metallic glass feedstock sample is heated uniformly. After heating and deforming, the article is cooled to a temperature below the Tg.

BRIEF DESCRIPTION OF THE DRAWINGS

The description will be more fully understood with reference to the following figures and data graphs, which are presented as various embodiments of the disclosure and should not be construed as a complete recitation of the scope of the disclosure.

DETAILED DESCRIPTION

Figure 1:
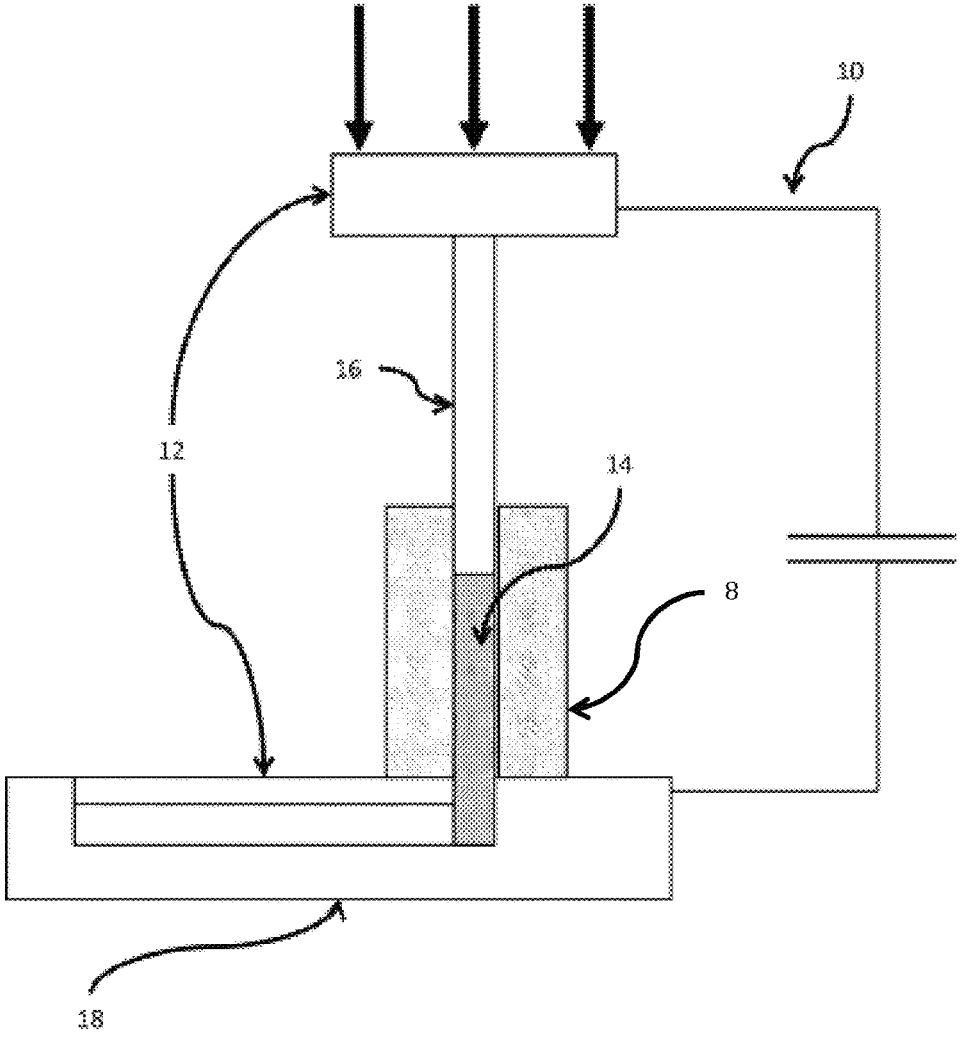
FIG. 1 provides a schematic of an exemplary embodiment of a rapid capacitor discharge forming apparatus in accordance with embodiments of the present disclosure.

The present disclosure is directed to feedstock barrels made of cellulosic materials, or synthetic polymeric materials or composites thereof, for use in the injection molding of metallic glasses using RCDF techniques.

RCDF techniques are methods of uniformly heating a metallic glass rapidly using Joule heating (e.g. heating times of less than 1 second, and in some embodiments less than 100 milliseconds), softening the metallic glass, and shaping it into a net shape article using a tool (e.g. an extrusion die or a mold). More specifically, the methods can utilize the discharge of electrical energy (e.g. 50 J to 100 kJ) stored in a capacitor to uniformly and rapidly heat a sample of a metallic glass to a "process temperature" between the glass transition temperature Tg of the metallic glass and the equilibrium melting point Tm of the metallic glass forming alloy in a time scale of several milliseconds or less, and is referred to hereinafter as rapid capacitor discharge forming (RCDF).

Operating in the "injection molding" mode, the RCDF process begins with the discharge of electrical energy into a sample block of metallic glass feedstock (e.g. a rod) loaded into a feedstock barrel. In some embodiments, at least 50 J of energy is discharged. In other embodiments, at least 100 J of energy may be discharged. In yet other embodiments at least 1000 J and still in others 10000 J of energy may be discharged. In some embodiments less than 100 kJ of energy may be discharged. In other embodiments, less than 1000 J of energy may be discharged, while in other embodiments less than 100 J of energy may be discharged. In further embodiments, the amount of energy discharged may range between 50 J and 100 kJ.

The discharge of electrical energy may be used to rapidly heat the sample to a "process temperature" above the Tg of the metallic glass, and more specifically to a processing temperature between the Tg of the metallic glass and the Tm of the metallic glass forming alloy, on a time scale of several microseconds to several milliseconds or less, such that the amorphous material has a process viscosity sufficient to allow facile shaping.

In some embodiments, the process viscosity may be at least 1 Pa-s. In other embodiments it may be at least 10 Pa-s or at least 100 Pas-s. In still other embodiments, the process viscosity may be less than 10000 Pa-s, or less than 1000 Pa-s. In yet other embodiments, the process viscosity may range from 1 to 10000 Pa-s.

Meanwhile, the processing temperature may be at least 50° C. greater than the Tg in some embodiments. In other embodiments, the processing temperature may be at least 100° C. greater than the Tg. Yet, in other embodiments, the processing temperature may be less than 100° C. below Tm or less than 50° C. below Tg.

In various embodiments, the ability to shape a sample of metallic glass as described in the present disclosure depends on the ability to heat the sample in a rapid and uniform manner across the block. If heating were not uniform, then the sample would instead experience localized heating and, although such localized heating can be useful for some techniques, such as, for example, joining or spot-welding pieces together, or shaping specific regions of the sample, such localized heating has not and cannot be used to perform bulk shaping of samples.

Likewise, if the sample heating were not sufficiently rapid (typically on the order of 500-$10^5$ K/s) then either the material being formed would lose its amorphous character (i.e. it would crystallize), or the shaping technique will be limited to those amorphous materials having superior processability characteristics (i.e., high stability of the supercooled liquid against crystallization), again reducing the utility of the process. In some embodiments, using RCDF, the metallic glass can be heated at heating rates of at least $10^3$ C/s. In other embodiments, the heating rate can be of at least $10^4$ C/s. In still other embodiments, the heating rate can be at least $10^5$ C/s. In further embodiments, the heating rate may between $10^3$ C/s and $10^6$ C/s.

In the context of this disclosure, the sample being heated uniformly means that the temperature within different regions of the heated sample does not vary by more than 20%. In other embodiments, the temperature within different regions of the uniformly heated sample does not vary by more than 10%. In yet other embodiments, the temperature in different regions of the uniformly heated sample does not vary by more than 5%. In yet other embodiments, the temperature within different regions of the uniformly heated sample does not vary by more than 1%. By heating uniformly, the metallic glass may be shaped into a high quality BMG article via injection molding.

In some embodiments, the sample is evenly heated such that the temperature within different regions of the heated sample does not vary by more than 20%. In other embodiments, the temperature within different regions of the evenly heated sample does not vary by more than 10%. In yet other embodiments, the temperature within different regions of the evenly heated sample does not vary by more than 5%. In yet other embodiments, the temperature within different regions of the evenly heated sample does not vary by more than 1%. By evenly heating, the metallic glass may be shaped into a high quality BMG article via injection molding. "Evenly heating" and "uniformly heating" can be used interchangeably.

A schematic of an exemplary RCDF apparatus in accordance with the RCDF method of the present disclosure is provided in FIG. 1. As shown, the basic RCDF apparatus includes a source of electrical energy (10) and at least a pair of electrodes (12) disposed at opposing ends of a feedstock barrel (8) that has a cavity in which a metallic glass can be loaded. The pair of electrodes is used to apply electrical energy to the metallic glass feedstock sample (14) disposed in the feedstock barrel (8). The electrical energy is used to heat the sample to the process temperature. The metallic glass feedstock sample forms a viscous liquid that can be simultaneously or consecutively shaped by injection molding in a mold (18) to form an amorphous article.

In one embodiment, shown schematically in FIG. 1, an injection molding apparatus may be incorporated with the RCDF method. In such an embodiment, the viscous liquid of the heated amorphous material is injected into a mold cavity (18) using, for example, a mechanically loaded plunger to form a net shape component of the metallic glass. In some embodiments, the mold is held at room temperature, while in other embodiments the mold is held to a temperature as high as Tg. In the example of the method illustrated in FIG. 1, the charge is located in the barrel described herein, and can be preloaded to an injection pressure (typically 1-100 MPa) by a cylindrical plunger made of a conducting material (such as copper or silver) having both high electrical conductivity and thermal conductivity. In certain embodiments, an electrode can also act as a plunger. The metallic glass sample may rest on an electrically grounded base electrode. The stored energy of a capacitor can be discharged across the metallic glass sample provided that certain criteria discussed above are met. The plunger, which in some embodiments may be pre-loaded, then drives the heated viscous melt into the mold cavity. It will be noted to those skilled in the art that the gate between the feedstock barrel (8) and mold (18) can be placed anywhere in relation to the feedstock barrel. In some embodiments, for example, the gate can be an opening in the barrel (embodiment not shown).

It should be understood that any source of electrical energy suitable for supplying a pulse of sufficient energy may be used. For example, a capacitor having a discharge time from 10 μs to 100 milliseconds may be used. In addition, any electrodes suitable for providing contact across the sample block may be used to transmit the electrical energy.

In the certain modes of RCDF, such as the injection molding mode, the RCDF apparatus includes a feedstock barrel that is used to house the feedstock, electrically insulate it during electrical discharge from the surrounding metal tooling, and mechanically confine it once it reaches its viscous state and the deformational force is applied. In some embodiments, the feedstock barrel can guide the deforming feedstock sample through an opening (i.e. sometimes referred to as a gate) in the barrel and onto a runner that leads to a mold cavity in which the softened feedstock would ultimately fill.

In general, the feedstock barrel can be electrically insulating and chemically stable at temperatures up to about 600° C., and in some embodiments up to about 800° C. The barrel can have adequate mechanical integrity up to such temperatures to sustain the stresses experienced during the RCDF injection molding process. Moreover, in order to be used repeatedly for multiple RCDF cycles, the barrel can exhibit cyclic mechanical and thermal performance, along with a capacity for custom machining to enable splitting of the barrel in every cycle in order to remove the remaining biscuit. These properties can limit the choice of materials for a repeated use barrel. Conventionally, feedstock barrels are formed from ceramic materials.

In various aspects, the disclosure is directed to cellulosic and synthetic polymeric materials that may be electrically insulating and may have thermal, chemical, and mechanical stability adequate for at least one RCDF cycle. Unlike ceramics, the machinability of cellulosic or synthetic polymeric barrels is greater (i.e. conventional machining methods and tools may be used without the use of precision cutting tools) and their raw cost is considerably lower. Such material can be used as single use (i.e. disposable) barrels. Since a single use barrel does not require a split design, the overall fabricability is less complex and overall cost is even lower in comparison to ceramic barrels. In many embodiments a single piece design may be implemented, meaning that the overall fabricability would be even less complex and overall cost even lower.

For the purposes of the disclosure it can be understood that cellulosic materials include any organic material derived at least partially from cellulose including natural wood and its derivatives like paper, fiberboard, etc. For the purposes of this disclosure, it will be understood that synthetic polymeric materials include any material comprising or derived at least partially from synthesized polymers, including thermoplastics, resins, epoxies, rubbers, etc. and composites comprising thermoplastics, resins, epoxies, rubbers, etc.

Feedstock barrels formed from a cellulosic material, or synthetic polymeric material, or composite thereof, in accordance with embodiments of the current disclosure are fundamentally different from ceramics in several aspects. In various embodiments, cellulosic materials, and synthetic polymeric materials and composites thereof, can be very easily machinable. With respect to cellulosic materials, machining processes for the specific example of wood can include sawing, planning, shaping, turning, boring, mortising, and sanding. Likewise, for synthetic polymeric materials machining processes for the specific example of G-10 Glass/Phenolic laminates can include drilling, turning, milling, boring, and reaming. Most of these processes are quite simple, efficient, and can be done using fairly inexpensive steel or carbide tools. In contrast, ceramics require more complex machining processes and/or the use of specialty tools such as sub-micron carbide or diamond coated cutting tools.

The price of cellulosic materials, and synthetic polymeric materials, and composites thereof, over other insulating materials is also an important factor in selecting a material for disposable RCDF barrel. Table 1 shows the approximate relative price of selected raw materials with the basis of mild steel being $100 per ton (Data from M. F. Ashby and D. R. H. Jones, Engineering Materials 1: An Introduction to Properties, Applications, and Design, 3rd Edition, Elsevier UK, 2005 pp. 19-20). The relative prices of cellulosic materials such as hard woods, plywood, and soft woods are $250, $200, and $70 per ton, respectively. The high machinability and low raw material cost render wood derived materials attractive for RCDF feedstock barrels. Specifically, cellulosic materials in general could be particularly attractive as single-use (i.e. disposable) RCDF feedstock barrels.

TABLE 1

Approximate relative price of raw materials per ton of selected materials.

| Material | Relative price in dollars per ton |
|---|---|
| Alumina, $Al_2O_3$ (fine ceramic) | 3000 |
| Fiber glass | 1000 |
| Glass | 400 |
| Hard Woods | 250 |
| Polyethylene | 200 |
| Plywood | 200 |
| Soft Woods | 70 |

The price of synthetic polymeric materials over other insulating materials is also an important factor in selecting synthetic polymeric materials as a material for disposable RCDF barrel. Table 2 shows the approximate relative price of selected raw materials with the basis of mild steel being $100 per ton (Data from M. F. Ashby and D. R. H. Jones, Engineering Materials 1: An Introduction to Properties, Applications, and Design, 3rd Edition, Elsevier UK, 2005 pp. 19-20). The relative prices of synthetic polymeric materials such as glass fiber reinforced polymers, polymethylmethacrylate, and widely used thermoplastics like polyethylene, polypropylene and polystyrene are $1000, $700, and $200 per ton, respectively. The high machinability and low raw material cost render synthetic polymeric materials attractive for RCDF feedstock barrels. Specifically, synthetic polymeric materials in general could be particularly attractive as single-use (i.e. disposable) RCDF feedstock barrels.

TABLE 2

Approximate relative price of raw materials per ton of selected materials.

| Material | Relative price in dollars per ton |
|---|---|
| Alumina, $Al_2O_3$ (fine ceramic) | 3000 |
| Polyimides | 8000 |
| Glass Fiber Reinforced Polymers | 1000 |
| Polymethylmethacrylate | 700 |
| Glass | 400 |
| Polyethylene | 200 |
| Polypropylene | 200 |
| Polystyrene | 200 |

In various embodiments, the cellulosic material, or synthetic polymeric material or composite thereof, properties may include (i) adequate toughness to withstand the stresses experienced in a single injection molding cycle (stresses on the barrel can be as high as 1 MPa, in other instances as high as 10 MPa, and in yet other instances as high as 100 MPa) such that catastrophic mechanical failure is avoided, (ii) high enough electrical resistivity and breakdown strength such that essentially no electrical current flows through the barrel during capacitive discharge, and (iii) adequate thermal and chemical stability such that catastrophic ignition is avoided with short-time (typically less than 1 s, and in some instances less than 100 ms) exposure to temperatures of up to about 600° C., and in some embodiments up to about 800° C. In various embodiments, the current disclosure is directed toward cellulosic materials, or synthetic polymeric materials or composites thereof, that can sufficiently satisfy these criteria.

A feedstock barrel material for RCDF injection molding can maintain the mechanical integrity to guide the softened metallic glass feedstock into the die. If the barrel cracks or otherwise deforms catastrophically, it can, among other things, inhibit the motion of the moving electrode/plunger and guide the softened metallic glass feedstock mostly through cracks in the barrel instead of flowing mostly through a runner to the mold cavity such that it adequately fills the mold. Such damage to the barrel is considered "catastrophic mechanical failure", and should be avoided if the barrel is to be able to function as a component of a RCDF injection molding process. In some aspects, the barrel can catastrophically fail by losing its shape or mechanical integrity. In some aspects, catastrophic mechanical failure of the barrel may comprise the development of cracks in the barrel that are larger than 10% of the barrel thickness. In other aspects, catastrophic mechanical failure of the barrel may comprise the development of a permanent strain in the barrel that is greater than 5%. Accordingly, in some embodiments, barrel materials can be selected that maintain structural integrity over at least one RCDF injection molding cycle to prevent catastrophic mechanical failure.

One measure of the ability of a material to resist cracking is the critical strain energy release rate, $G_c$. Table 3 shows $G_c$ for several materials including cellulosic materials. Different cellulosic materials will naturally have different $G_c$ values and properties. In the specific example of common wood, $G_c$ ranges between 8 and 20 J/m$^2$ for cracks developing perpendicular to the grain, and ranges between 0.5 and 2 J/m$^2$ for cracks developing parallel to the grain (Data from Ashby and Jones. Engineering Materials 1, Second Edition. Butterworth-Heinemann. 1996. p. 138). This variation of $G_c$ is a consequence of the orthotropic nature of natural wood. Natural wood is also a porous material. Generally, the fracture toughness, $K_{IC}$, of natural wood increases as its relative density increases (i.e. as its porosity decreases). As the relative density varies between cellulosic materials from about 5% to about 50%, the toughness varies from about 0.1 to 10 MPa m$^{1/2}$ for cracks developing parallel to the grain and from about 0.01 to 1 MPa m$^{1/2}$ for cracks developing perpendicular to the grain (Data from Gibson and Ashby, Cellular Solids: Structure and properties—Second Edition. Cambridge University Press. 1997. p. 408).

Based on this data, in some variations higher density cellulosic materials may be suited for use as feedstock barrels, although a large variety of cellulosic materials may have toughness allowing use as feedstock barrels. In addition, other engineered cellulosic materials, like fiberboard or paper laminates, can be made to be isotropic, lacking grain, or designed so that any grain is configured to produce the desired properties in the desired direction of loading. Such composite cellulosic materials can be manufactured by binding fibers, strands, particles, or veneers of woods with adhesive, and some examples include plywood, medium-density-fiberboard (MDF), particle board, and cardboard. These engineered composites can be considerably tougher than natural woods in certain directions (e.g. in some instances two times tougher in certain directions, in other instances five times tougher in certain directions, and in yet other instances ten times tougher in certain directions), and thus may be more suitable for forming feedstock barrels. To withstand the stresses applied during the RCDF cycle, in some embodiments a cellulosic barrel material may have $G_c$ of at least 0.1 kJ/m$^2$ and $K_{IC}$ of at least 0.05 MPa m$^{1/2}$. In another embodiment, a cellulosic barrel material may have $G_c$ of at least 0.5 kJ/m$^2$ and $K_{IC}$ of at least 0.1 MPa m$^{1/2}$. In yet another embodiment, a cellulosic barrel material may have $G_c$ of at least 5 kJ/m$^2$ and $K_{IC}$ of at least 5 MPa m$^{1/2}$ in the direction of the applied stress. In still other embodiments, a cellulosic barrel material may have $G_c$ of at least 1 kJ/m$^2$ and $K_{IC}$ of at least 0.5 MPa m$^{1/2}$.

TABLE 3

Toughness ($G_c$) and fracture toughness ($K_{IC}$) of selected materials.

| Material | $G_c$ (kJ/m$^2$) | $K_{IC}$ (MPa m$^{1/2}$) |
|---|---|---|
| Mild Steel | 100 | 140 |
| Aluminum alloys | 8-30 | 23-45 |
| Common Woods ⊥ to grain | 8-20 | 11-13 |
| Common Woods ‖ to grain | 0.5-2 | 0.5-1 |
| Alumina | 0.02 | 3-5 |
| Soda Glass | 0.01 | 0.7-0.8 |

In other variations, Table 4 shows $G_c$ for several materials, including synthetic polymeric materials. Different synthetic polymeric materials can have different $G_c$ values and properties. In the specific example of glass fiber reinforced polymers, $G_c$ is between 10 and 100 kJ/m$^2$ and the fracture toughness, $K_{IC}$, falls between 20 and 60 MPa m$^{1/2}$ (Data from Ashby and Jones. Engineering Materials 1, Second Edition. Butterworth-Heinemann. 1996. p. 138.). These variations in $G_c$ and $K_{IC}$ come from the variety of available polymers and the varying geometry and orientation of the reinforcing fibers/particulates that may be present in the composite polymers. In certain directions these engineered polymeric composites can be considerably tougher than both the polymer matrix and reinforcing fibers/particulates (e.g. in some instances two times tougher in certain directions, in other instances five times tougher in certain directions, and in yet other instances ten times tougher in certain directions). To withstand the stresses applied during the RCDF cycle, in some embodiments a synthetic polymeric barrel material can have $G_c$ of at least 0.1 kJ/m$^2$ and $K_{IC}$ of at least 0.05 MPa m$^{1/2}$. In another embodiment, a synthetic polymeric barrel material can have $G_c$ of at least 0.5 kJ/m$^2$ and $K_{IC}$ of at least 0.1 MPa m$^{1/2}$. In yet another embodiment, a synthetic polymeric barrel material may have $G_c$ of at least 5 kJ/m$^2$ and $K_{IC}$ of at least 5 MPa m$^{1/2}$ in the direction of the applied stress.

TABLE 4

Toughness ($G_c$) and fracture toughness ($K_{IC}$) of selected materials.

| Material | $G_c$ (kJ/m$^2$) | $K_{IC}$ (MPa m$^{1/2}$) |
|---|---|---|
| Mild Steel | 100 | 140 |
| Aluminum alloys | 8-30 | 23-45 |
| Glass Fiber Reinforced Polymers | 10-100 | 20-60 |
| Polypropylene | 8 | 3 |
| High Density Polyethylene | 6-7 | 2 |
| Polymethyl Methacrylate | 0.3-0.4 | 0.9-1.4 |
| Alumina | 0.02 | 3-5 |
| Soda Glass | 0.01 | 0.7-0.8 |

The feedstock barrel can insulate the electrical path passing from the two electrodes through the feedstock from the surrounding metal tooling. Accordingly, in some embodiments the barrel material can have a high electrical resistivity to prevent the flow of electrons, and sufficient dielectric breakdown strength to prevent electrical discharge across the material itself. In order to achieve efficient current flow through the feedstock, the resistivity of the barrel can be higher than that of the feedstock. Metallic glasses have resistivity in the range of 100-200 μΩ-cm. In one embodiment, the resistivity of the barrel can be at least $10^3$ times higher than that of the feedstock, so the barrel material can have resistivity of at least $1\times10^5$ μΩ-cm. If the feedstock and barrel were parallel resistors of equal size, this would pass approximately 99.9% of the current through the feedstock. In another embodiment, the resistivity of the barrel can be at least $10^6$ times higher than that of the feedstock, so the barrel material can have resistivity of at least $1\times10^8$ μΩ-cm.

A list of the resistivity of selected cellulosic materials is shown in Table 5 (Data from CRC Handbook of Chemistry and Physics, 93$^{rd}$ Edition, from CRC Materials Science and Engineering Handbook, Third Edition, and from Weatherwax and Stamm, Electrical Engineering, 64(12). 1945). Natural wood is seen to have resistivity of at least $1\times10^{11}$ μΩ-cm when wet and much higher when dried (up to $3\times10^{24}$ μΩ-cm), thereby satisfying one or more criteria set forth in this disclosure.

Concerning dielectric breakdown strength of cellulosic materials, in one example of the disclosure, a barrel having thickness of up to 10 mm should be able to resist electrical discharge across it under applied voltages of up to 1 kV. As such, a barrel material would have a dielectric breakdown strength of at least 100 V/mm. In another example of the disclosure, a barrel material would have a dielectric breakdown strength of at least 1000 V/mm.

TABLE 5

Resistivity of selected materials. Measured at room temperature except where noted.

| Material | Resistivity (μΩ cm) |
|---|---|
| Copper | 1.543 |
| Aluminum | 2.417 |
| 1020 Steel | 18 |
| 304 Stainless Steel | 72 |
| Metallic Glass Alloys | 100-200 |
| Graphite | 750-6000 |
| Pyrex (at 350° C.) | $4 \times 10^{12}$-$2.5 \times 10^{15}$ |
| Fused Silica Glass (at 350° C.) | $4 \times 10^{15}$-$3 \times 10^{16}$ |
| Alumina | $>1 \times 10^{20}$ |
| Yttria-Stabilized Zirconia | $1 \times 10^{15}$ |
| Wood (30% moisture) | $1 \times 10^{11}$-$1 \times 10^{12}$ |
| Wood (oven dried) | $3 \times 10^{23}$-$3 \times 10^{24}$ |

A list of the resistivity of selected synthetic polymeric materials is shown in Table 6 (Data from CRC Handbook of Chemistry and Physics, 93rd Edition, from CRC Materials Science and Engineering Handbook, Third Edition, and from www.matweb.com). Synthetic polymeric materials have widely ranging restivities, many of which are greater than $1\times10^{8}$ μΩ-cm and even more of which are greater than $1\times10^{5}$ μΩ-cm, thereby satisfying the criteria set forth in this disclosure.

Concerning dielectric breakdown strength of synthetic polymeric materials and composites, in one embodiment, a barrel having thickness of up to 10 mm should be able to resist electrical discharge across it under applied voltages of up to 1 kV. In such embodiments, a barrel material would have a dielectric breakdown strength of at least 0.1 kV/mm. In another embodiment, a barrel material would have a dielectric breakdown strength of at least 1 kV/mm. A list of the dielectric strength of selected materials is shown in Table 7. (Data from CRC Data from CRC Handbook of Chemistry and Physics, 93rd Edition, from CRC Materials Science and Engineering Handbook, Third Edition, and from S. Karmakar, "An Experimental Study of Air Breakdown Voltage and its Effects on Solid Insulation", Journal of Electrical Systems 8-2, 209-217 (2012)). As evidenced by Table 7, a wide variety of cellulosic and synthetic polymeric materials have dielectric strengths of at least 1 kV/mm, and some have dielectric strength higher than engineering ceramics like Alumina and Zirconia, thereby satisfying the criteria set forth in this disclosure.

TABLE 6

Resistivity of selected materials. Measured at room temperature except where noted.

| Material | Resistivity (μΩ cm) |
|---|---|
| Copper | 1.543 |
| Aluminum | 2.417 |
| 1020 Steel | 18 |
| 304 Stainless Steel | 72 |
| Metallic Glass Alloys | 100-200 |
| Graphite | 750-6000 |
| Pyrex (at 350° C.) | $4 \times 10^{12}$-$2.5 \times 10^{15}$ |
| Fused Silica Glass (at 350° C.) | $4 \times 10^{15}$-$3 \times 10^{16}$ |
| Alumina | $>1 \times 10^{20}$ |

TABLE 6-continued

Resistivity of selected materials. Measured at room temperature except where noted.

| Material | Resistivity (μΩ cm) |
|---|---|
| Yttria-Stabilized Zirconia | $1 \times 10^{15}$ |
| Polytetrafluoroethylene | $>10^{12}$ |
| High Density Polyethylene | $>10^{6}$ |
| G-10 Glass/Phenolic Laminate | $6 \times 10^{18}$ |
| G-9 Glass/Melamine Laminate | $1.5 \times 10^{19}$ |

TABLE 7

Dielectric strength of selected materials. Measured at room temperature.

| Material | Dielectric Strength kV/mm |
|---|---|
| Zirconia | 11.4 |
| Alumina | 13.4 |
| Standard Window Glass | 9.8-13.8 |
| Fused Silica Glass | 470-670 |
| Polytetrafluoroethylene film | 87-173 |
| Polypropylene | 23.6 |
| Polystyrene | 19.7 |
| Polymethylmethacrylate | 19.7 |
| High Density Polyethylene | 19.7 |
| G-10 Glass/Phenolic Laminate | 15.0 |
| G-9 Glass/Melamine Laminate | 13.4 |
| Polyester Fiber | 25.5 |
| Plywood | 1.9 |
| Paper | 7-26 |
| Craft Paper | 53-68 |
| Leatheroid | 16.8-18.4 |
| Lamiflex | 16-22 |

In certain embodiments, in a single RCDF injection molding cycle, the feedstock which is in direct contact with the feedstock barrel is heated to temperatures up to about 600° C., and in some embodiments up to about 800° C., thereby reaching a state conducive to viscous flow. It is then forced out of the feedstock barrel through a runner and into a die cavity. All these steps occur over a time typically under 0.5 s. In many embodiments, the feedstock barrel may be able to withstand these elevated temperatures for a limited time without losing its ability to electrically insulate and effectively confine and guide the softened feedstock. Materials having an operating temperature as high as 800° C. meet this criterion.

Table 8 shows the maximum service temperature for several materials, including cellulosic materials. Table 9 shows the maximum service temperature for several materials, including synthetic polymer materials.

TABLE 8

Maximum Service Temperature of selected materials.

| Material | Maximum Service Temperature (° C.) |
|---|---|
| Pyrex | 821 (softening point) |
| Fused Silica Glass | 1583-1710 (softening point) |
| Alumina | 1750 |
| Yttria-Stabilized Zirconia | 1500 |
| Pine Wood, Dry | 427 (auto ignition temperature) |
| Oak Wood, Dry | 482 (auto ignition temperature) |
| Polytetrafluroethylene | 93.3-316 |
| Phenolic resin | 150-219 |
| High-Density Polyethylene | 70-120 |

TABLE 9

Maximum Service Temperature of selected materials.

| Material | Maximum Service Temperature (° C.) |
|---|---|
| Pyrex | 821 (softening point) |
| Fused Silica Glass | 1583-1710 (softening point) |
| Alumina | 1750 |
| Yttria-Stabilized Zirconia | 1500 |
| Polytetrafluoroethylene | 250 |
| High Density Polyethylene | 80 |
| Polypropylene | 100 |
| G-10 Glass/Phenolic Laminate | 140 |
| G-9 Glass/Melamine Laminate | 140 |

In some embodiments, materials with lower operating temperatures may withstand temperatures as high as 600° C., and in some embodiments as high as 800° C., for brief periods (e.g. less than 0.5 s) without suffering catastrophic ignition, that is, decomposing catastrophically or losing their shape, mechanical integrity, or their ability to electrically insulate as a result of the high temperatures, would also meet this criterion.

Figure 2:
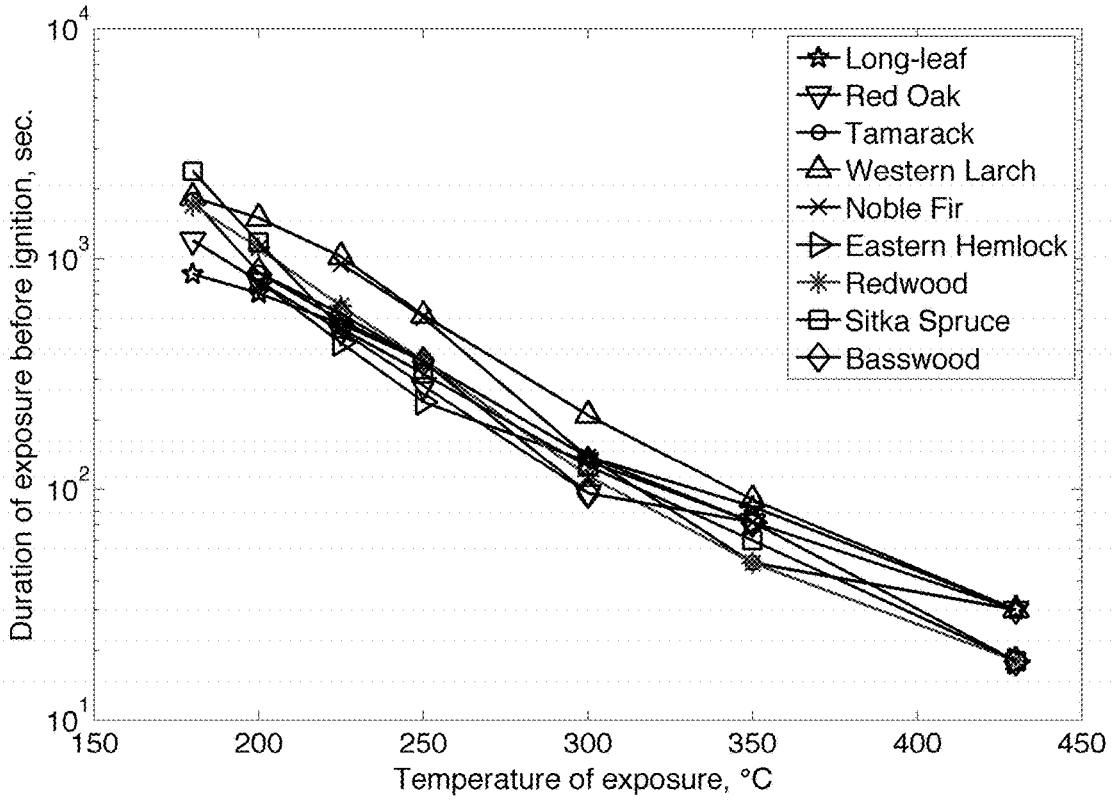
FIG. 2 provides a plot of time to ignition versus exposure temperature for several woods with data from USDA Forest Products Laboratory Report 1464.

As an example of a cellulosic material, consider dried natural wood. Dried natural wood has an auto ignition temperature between 425° C. and 485° C., which is lower than the 800° C. of the RCDF injection molding process (Data from www.matweb.com and www.engineeringtoolbox.com). However, this ignition temperature for natural wood is time-dependent. As such, natural wood exposed to elevated temperatures can resist ignition for a certain amount of time. For example, red oak and western larch can resist ignition for up to 0.5 minutes when exposed to a temperature of 430° C. (data from USDA Forest Products Laboratory Report 1464). FIG. 2 shows the time required for ignition as a function of exposure temperature for several cellulosic materials (data from USDA Forest Products Laboratory Report 1464). As the temperature increases, the time for ignition for all of the cellulosic materials displayed in FIG. 2 decreases exponentially. Extrapolating this behavior to 800° C., it appears that wood can resist ignition for several seconds at that temperature. Other cellulosic materials have ignition behavior similar to natural wood. In the RCDF process a cellulosic feedstock barrel is expected to be exposed to a temperature as high as 800° C. for a time shorter than 0.5 s. As such, a barrel containing cellulosic materials can be expected to adequately resist ignition during RCDF.

As an example of a synthetic polymeric material consider G-10 glass/phenolic laminate. G-10 glass/phenolic laminate has a maximum continuous operating temperature of 140° C., which is lower than the 600° C. or 800° C. limit of the RCDF injection molding process (Data from CRC Data from CRC Handbook of Chemistry and Physics, 93$^{rd}$ Edition, from CRC Materials Science and Engineering Handbook, Third Edition). However, the short time duration of the RCDF process limits the depth to which the high temperature penetrates into the barrel material. As such, barrels made from some synthetic polymeric materials exposed to elevated temperatures can avoid catastrophic failure.

It will be understood that entirely preventing any ignition or decomposition is not required. Rather, the requirement is that during such exposure, any ignition or decomposition that might happen would be limited to a thin layer immediately adjacent to the hot feedstock such that the overall shape and mechanical properties of the barrel would not be impaired, i.e., that catastrophic failure of the barrel by ignition or decomposition would be avoided.

Although the above discussion has focused on the features of certain exemplary shaping techniques, such as injection molding, it should be understood that other shaping techniques may be used with the RCDF method of the current disclosure, such as extrusion or die casting. Moreover, additional elements may be added to these techniques to improve the quality of the final article. For example, to improve the surface finish of the articles formed in accordance with any of the above shaping methods the mold or stamp may be heated to around or just below the glass transition temperature of the metallic glass, thereby preventing surface defects. In addition, to achieve articles with better surface finish or net-shape parts, the compressive force, and in the case of an injection molding technique the compressive speed, of any of the above shaping techniques may be controlled to avoid a melt front instability arising from high "Weber number" flows, i.e., to prevent atomization, spraying, flow lines, etc.

The RCDF shaping techniques and alternative embodiments discussed above may be applied to the production of small, complex, net shape, high performance metal components such as casings for electronics, brackets, housings, fasteners, hinges, hardware, watch components, medical components, camera and optical parts, jewelry etc. The RCDF method can also be used to produce small sheets, tubing, panels, etc. which could be dynamically extruded through various types of extrusion dyes used in concert with the RCDF heating and injection system.

The methods and apparatus herein can be valuable in the fabrication of electronic devices using bulk metallic glass articles. In various embodiments, the metallic glass may be used as housings or other parts of an electronic device, such as, for example, a part of the housing or casing of the device. Devices can include any consumer electronic device, such as mobile phones, desktop computers, laptop computers, and/or portable music players. The device can be a part of a display, such as a digital display, a monitor, an electronic-book reader, a portable web-browser, and a computer monitor. The device can also be an entertainment device, including a portable DVD player, DVD player, Blue-Ray disk player, video game console, music player, such as a portable music player. The device can also be a part of a device that provides control, such as controlling the streaming of images, videos, sounds, or it can be a remote control for an electronic device. The alloys can be part of a computer or its accessories, such as the hard driver tower housing or casing, laptop housing, laptop keyboard, laptop track pad, desktop keyboard, mouse, and speaker. The metallic glass can also be applied to a device such as a watch or a clock.

EXAMPLES

The following examples illustrate various aspects of the disclosure. It will be apparent to those skilled in the art that many modifications, both to materials and methods, may be practiced without departing from the scope of the disclosure.

Example 1

RCDF injection molding experiments have been carried out using metallic glass feedstock rods of $Ni_{68.17}Cr_{8.65}Nb_{2.98}P_{16.42}B_{3.28}Si_{0.50}$ (in atomic %) using feedstock barrels made of natural oak and maple. Feedstock rods with diameters of 4.9 mm and lengths ranging from 23.18 mm to 26.94 mm were heated by capacitive discharge with an imparted energy of 3450 J/cm$^3$ under an applied axial load of 315 lb. The energy and force were applied by a 5 mm diameter copper electrode/plunger rod. The feedstock rod was supported from below by another 5 mm diameter copper stationary electrode rod. The softened feedstock material was injected under the applied axial load through a 3 mm gate in the side of the barrel into a copper strip mold cavity with dimensions of 1.5 mm×5 mm×20 mm, where, after filling, it cooled to form a metallic glass strip.

Figure 3:
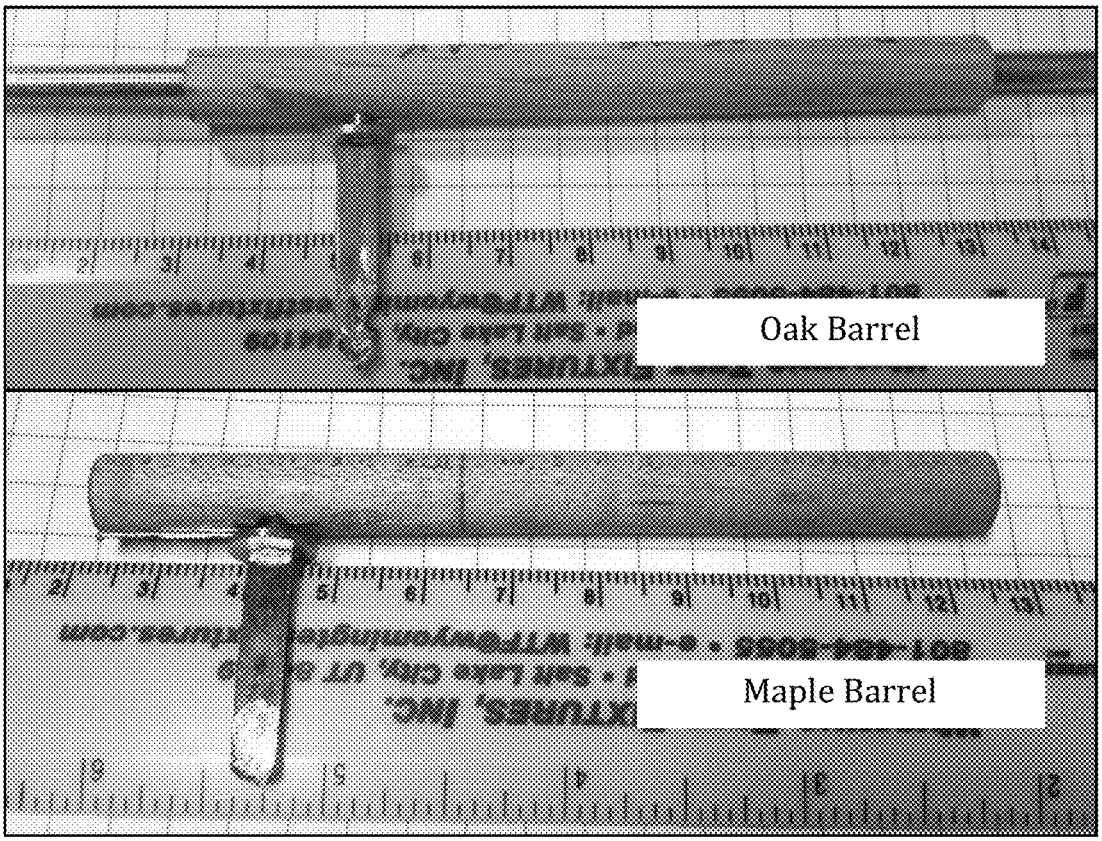
FIG. 3 provides images of injection molded parts with attached wooden feedstock barrels in accordance with embodiments of the present disclosure.
Figure 4A:
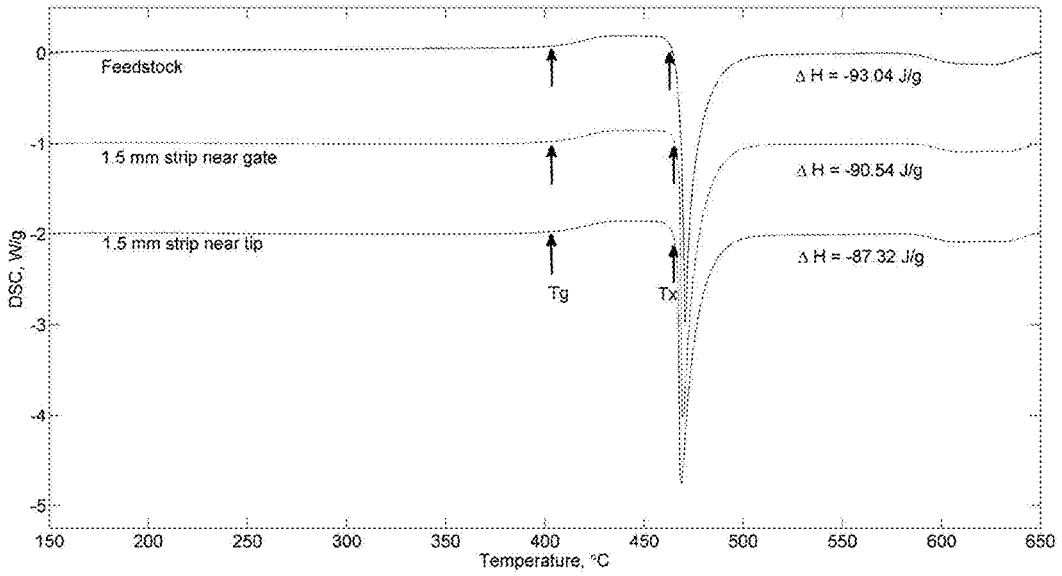
FIG. 4A shows a differential calorimetry scan verifying the amorphous nature of a part formed using an oak barrel in accordance with embodiments of the present disclosure.
Figure 4B:
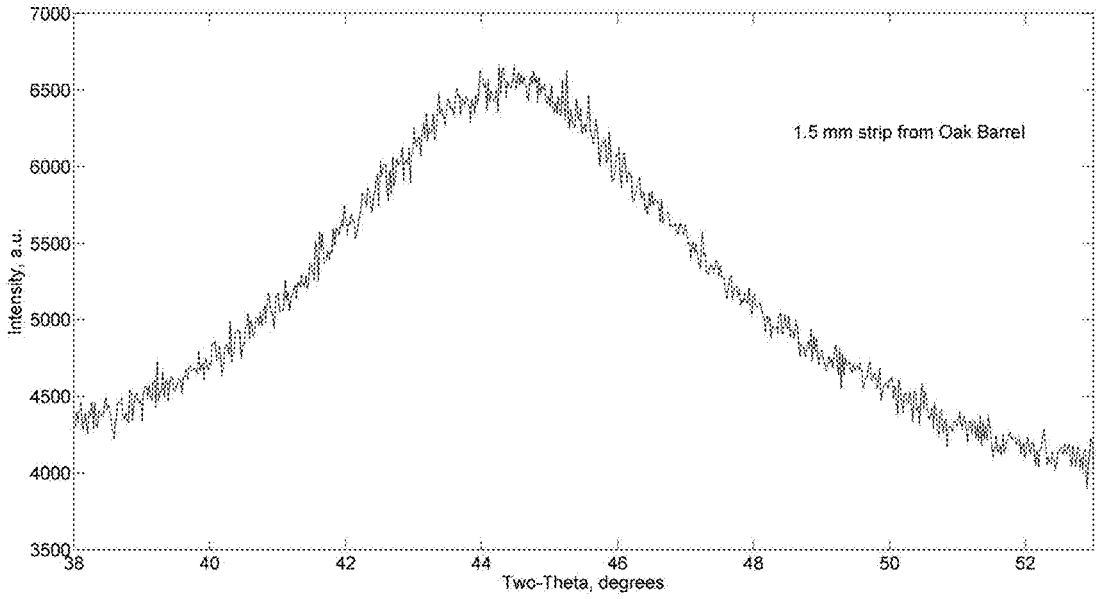
FIG. 4B shows an x-ray diffractogram verifying the amorphous nature of a part formed using an oak barrel in accordance with embodiments of the present disclosure.

Photographs of parts made with oak and maple barrels shown with the respective barrels are presented in FIG. 3. Both barrels made of cellulosic materials are shown to have adequately withstood the forces encountered during the RCDF injection molding process, with the oak barrel shown to be somewhat more robust in comparison as no cracking or opening near the gate is evident. The strips are shown to have filled the mold cavity entirely and reproduced the mold features reasonably well, particularly near the entrance to the mold cavity. The amorphous nature of the molded part made using the oak barrel was verified by differential scanning calorimetry (DSC) and X-ray diffraction (XRD). The results of this analysis are shown in FIGS. 4A and 4B. The DSC plots suggest that the molded metallic glass strip along its entire length exhibits a very similar scan to that of the metallic glass feedstock, while no crystallographic peaks can be detected in the XRD scan.

Example 2

RCDF injection molding experiments have been carried out using metallic glass feedstock rods of $Ni_{68.17}Cr_{8.65}Nb_{2.98}P_{16.42}B_{3.28}Si_{0.50}$ (in atomic %) using polymeric feedstock barrels made of G-10 Glass/Phenolic Laminate. Feedstock rods with diameters of 4.9 mm and lengths ranging from 23.78 mm to 27.27 mm were heated by capacitive discharge with an imparted energy of 3450 J/cm$^3$ under an applied axial load of 315 lb. The energy and force were applied by a 5 mm diameter copper electrode/plunger rod. The feedstock rod was supported from below by another 5 mm diameter copper stationary electrode rod. The softened feedstock material was injected under the applied axial load through a 3 mm gate in the side of the barrel into a copper strip mold cavity with dimensions of 1.5 mm×5 mm×20 mm, where, after filling, it cooled to form an amorphous strip.

Figure 5:
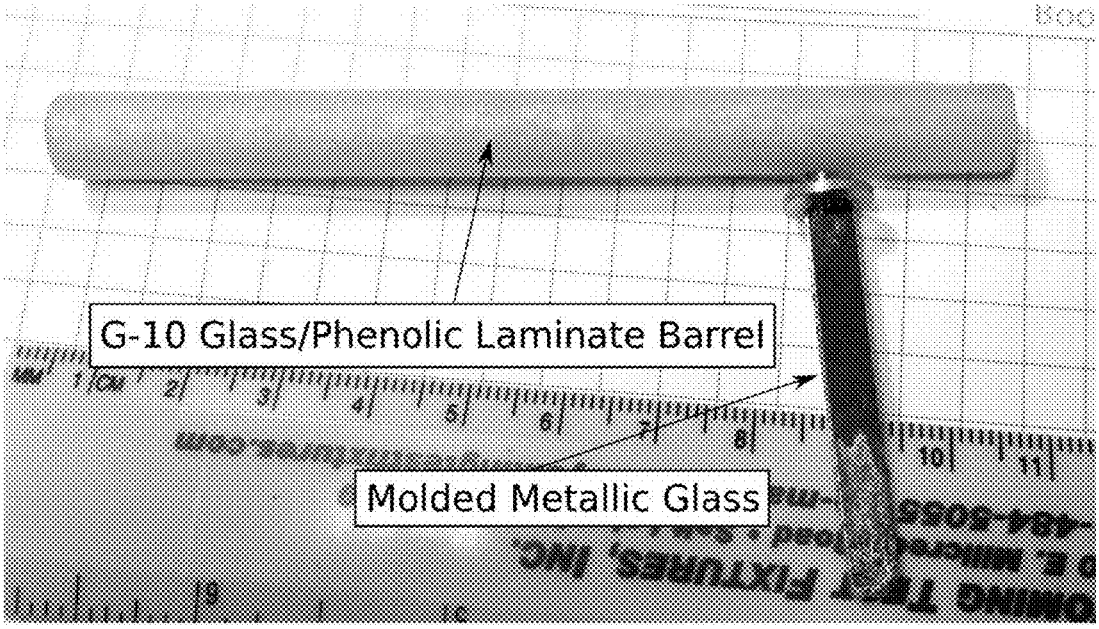
FIG. 5 provides an image of an injection molded part with attached G-10 Glass/Phenolic laminate feedstock barrels. Note the region near the dark colored region near the barrel.
Figure 6A:
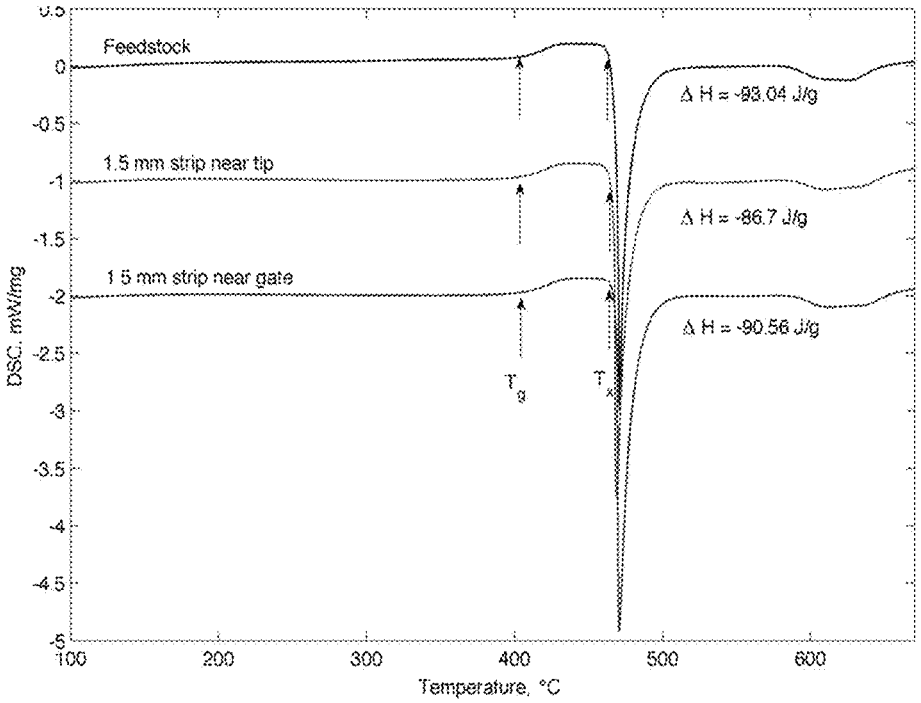
FIG. 6A shows a differential calorimetry scan verifying the amorphous nature of a part formed using a G-10 Glass/Phenolic laminate barrel in accordance with embodiments of the present disclosure.
Figure 6B:
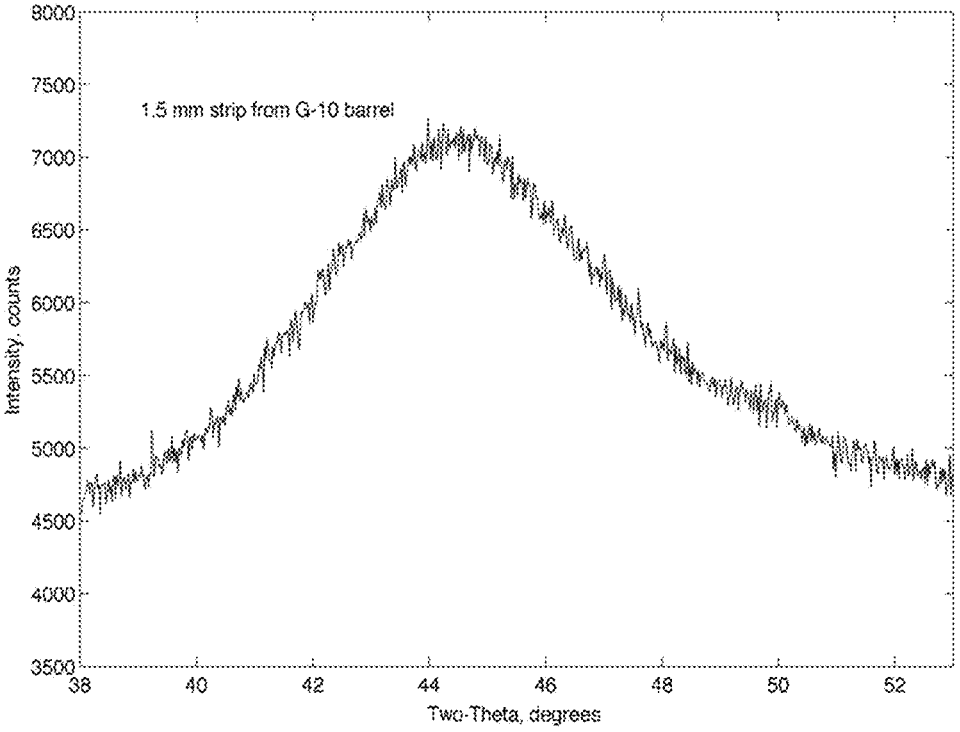
FIG. 6B shows an x-ray diffractogram verifying the amorphous nature of a part formed using a G-10 Glass/Phenolic laminate barrel in accordance with embodiments of the present disclosure.

A photograph of a part made with a G-10 glass/phenolic laminate barrel shown with the barrel is presented in FIG. 5. The G-10 glass/phenolic laminate barrel is shown to have adequately withstood the forces encountered during the RCDF injection molding process. No cracking or opening near the gate is evident. The strip is shown to have filled a significant portion of the high aspect ratio mold cavity and reproduced the mold features reasonably well through a significant portion of its length (the dark region of the injection molding in FIG. 5), particularly near the entrance to the mold cavity. The amorphous nature of the molded part made using the G-10 Glass/Phenolic Laminate barrel was verified by differential scanning calorimetry (DSC) and X-ray diffraction (XRD). The results of this analysis are shown in FIGS. 6A and 6B. The DSC plots suggest that the molded metallic glass strip along its entire length exhibits a very similar scan to that of the metallic glass feedstock, while no crystallographic peaks can be detected in the XRD scan.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the embodiments disclosed herein. Accordingly, the above description should not be taken as limiting the scope of the document.

Those skilled in the art will appreciate that the disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the methods and systems described herein, which, as a matter of language, might be said to fall therebetween.

What is claimed is:

1. An RCDF apparatus comprising:

an electrically insulating feedstock barrel that comprises a cellulosic material or synthetic polymeric material;

a source of electrical energy configured to heat a metallic glass feedstock sample, wherein the source is electrically connected to at least one of a pair of electrodes, the at least one pair of electrodes are configured to electrically connect the source of electrical energy to the metallic glass feedstock sample when the metallic glass feedstock sample is disposed in the feedstock barrel and the electrodes are disposed at opposing ends of the feedstock barrel in contact with the metallic glass feedstock sample; and a shaping tool disposed in forming relation to the metallic glass feedstock sample, the shaping tool configured to apply a deformation force sufficient to shape the metallic glass feedstock sample when heated to an article.

2. The RCDF apparatus of claim 1, wherein the shaping tool is configured to cool the article at a rate sufficient to avoid crystallization.

3. The RCDF apparatus according claim 1, wherein the cellulosic or synthetic polymeric material has a critical strain energy release rate of at least 0.1 kJ/m$^2$.

4. The RCDF apparatus according to claim 1, wherein the cellulosic or synthetic polymeric material has a fracture toughness of at least 0.05 MPa m$^{1/2}$.

5. The RCDF apparatus according to claim 1, wherein the cellulosic or synthetic polymeric material has an electrical resistivity of at least $1\times10^5$ μΩ-cm.

6. The RCDF apparatus according to claim 1, wherein the cellulosic or synthetic polymeric material has a dielectric breakdown of at least 100 V/mm.

7. The RCDF apparatus according claim 1, wherein the cellulosic or synthetic polymeric material has a critical strain energy release rate of at least 0.1 kJ/m$^2$, a fracture toughness of at least 0.05 MPa m$^{1/2}$, an electrical resistivity of at least $1\times10^5$ μΩ-cm, and a dielectric breakdown of at least 100 V/mm.

8. The RCDF apparatus according to claim 1, wherein the RCDF apparatus is configured such that the maximum temperature in the cellulosic or synthetic polymeric material is 600° C. or less.

9. The RCDF apparatus according to claim 1, wherein RCDF apparatus is configured such that the maximum temperature in the cellulosic or synthetic polymeric material is 800° C. or less.

10. The RCDF apparatus according to claim 9, wherein the RCDF apparatus is configured such that the cellulosic or synthetic polymeric material is exposed to the maximum temperature for an exposure time of 0.5 s or less.

11. The RCDF apparatus according to claim 1, wherein the cellulosic material comprises a material selected from hardwood, softwood, plywood, medium-density-fiberboard (MDF), particle board, cardboard, paper, and craft paper.

12. The RCDF apparatus according to claim 1, wherein the synthetic polymeric material comprises a material selected from thermoplastics, resins, epoxies, rubbers, glass fiber reinforced polymers, polymethylmethacrylate, polyethylene, polypropylene and polystyrene.

13. The RCDF apparatus according to claim 1, wherein the cellulosic or synthetic polymeric material has a critical strain energy release rate of at least 5 $kJ/m^2$ in the direction of the applied stress.

14. The RCDF apparatus according to claim 1, wherein the cellulosic or synthetic polymeric material has a fracture toughness of at least 5 MPa $m^{1/2}$ in the direction of the applied stress.

15. The RCDF apparatus according to claim 1, wherein the shaping tool is an injection mold.

16. The RCDF apparatus according to claim 1, further comprising the metallic glass feedstock sample loaded into the feedstock barrel.

17. A method of heating and shaping the metallic glass feedstock sample using the RCDF apparatus of claim 1, the method comprising:

discharging electrical energy across the metallic glass feedstock sample disposed in the electrically insulating feedstock barrel to heat the metallic glass feedstock sample to a processing temperature between the Tg of the metallic glass feedstock sample and Tm of the metallic glass feedstock sample;

applying the deformation force to shape the heated metallic glass feedstock sample into the article; and cooling said article to a temperature below the Tg of the metallic glass feedstock sample.

18. The method of claim 17 wherein the electrically insulating feedstock barrel is configured to resist catastrophic mechanical failure during an RCDF cycle.

19. The method of claim 17, wherein essentially no electrical current flows through the electrically insulating feedstock barrel during an RCDF cycle.

* * * * *